US006827482B2

(12) United States Patent
Lafond et al.

(10) Patent No.: US 6,827,482 B2
(45) Date of Patent: Dec. 7, 2004

(54) SPILLAGE COLLECTION BAG FOR DEVICES THAT BLEND THE CONTENTS OF A SAMPLING BAG

(75) Inventors: Danielle Lafond, Beloeil (CA); Steve Jalbert, Montreal (CA)

(73) Assignee: Labplas Inc., Sainte-Julie (CA)

( * ) Notice: Subject to any disclaimer, the term of this patent is extended or adjusted under 35 U.S.C. 154(b) by 0 days.

(21) Appl. No.: 10/439,292

(22) Filed: May 16, 2003

(65) Prior Publication Data

US 2004/0027916 A1 Feb. 12, 2004

(30) Foreign Application Priority Data

May 17, 2002 (CA) ..... 2386696

(51) Int. Cl.[7] ..... B01F 11/00; B01F 15/00

(52) U.S. Cl. ..... 366/349; 366/348; 366/333; 366/197

(58) Field of Search ..... 366/197, 349, 366/348, 347, 332, 333

(56) References Cited

U.S. PATENT DOCUMENTS

| | | | | |
|---|---|---|---|---|
| 3,819,158 A | * | 6/1974 | Sharpe et al. | 366/349 |
| 5,243,833 A | * | 9/1993 | Coelho et al. | 604/903 |
| 5,564,829 A | | 10/1996 | Lafond | |
| 6,142,661 A | * | 11/2000 | Lafond | 366/197 |
| 6,267,498 B1 | | 7/2001 | Lafond et al. | |
| 6,273,600 B1 | * | 8/2001 | Sharpe | 366/197 |

* cited by examiner

*Primary Examiner*—Tony G. Soohoo
(74) *Attorney, Agent, or Firm*—Goudreau Gage Dubuc

(57) ABSTRACT

A blending device for mixing a content of a bag in combination with a collection member, the blending device comprising a casing defining a chamber and comprising a mixer and a door. The collection member is adapted to receive therein a bag with a content to be mixed by the blending device and is adapted to be installed in the blending device. When the collection member and the bag are positioned in the chamber and the door is closed, the mixer is operated to act on the bag and cause the content thereof. If the bag ruptures while in the blending device, its content will be collected by the collection member. The collection member is detachably secured at an upper end thereof to the blending device. The collection member typically takes the form of a flexible collection bag that is open-ended at its upper end.

11 Claims, 3 Drawing Sheets

SPILLAGE COLLECTION BAG FOR DEVICES THAT BLEND THE CONTENTS OF A SAMPLING BAG

BACKGROUND OF THE INVENTION

1. Field of the Invention

The present invention relates to devices for blending, mixing and/or homogenizing the contents of a bag and, more particularly, of a sterile plastic bag holding clinical samples, for instance used in laboratories, in hospitals, in the food industry, etc.

2. Description of the Prior Art

It is well known to provide sterile plastic bags for holding samples, such as the plastic bag disclosed in U.S. Pat. No. 5,564,829 issued on Oct. 15, 1996 to Lafond. In this patent a disposable sterile plastic bag is disclosed for holding samples in blenders during the mixing thereof, the bag B comprising a two-ply sheet flexible material integrally joined at opposed side edges thereof (or the bag may be made from a tube) and joined at the upper and lower ends thereof respectively by upper and lower heat seals with a sealed sample receiving chamber being defined between the two plastic sheets inwardly of the bag's side edges and upper and lower sealed ends. Inwardly of the upper seal, there is defined a tear-off line transversely across the two sheets and parallelly to the upper seal thereby forming a detachable strip outwardly of the tear-off line. When the sample is ready to be introduced in the bag, the detachable strip is removed from the bag by pulling it so as to cause rupture of the two sheets at the tear-off line. The bag's chamber is thus sterile when the sample is introduced therein and the bag and its contents can then be inserted in a blending machine, also called a homogenizer or a mixer. The bag's sterility does not depend on how the bag is packaged or on the integrity of the packaging's seal as the bag is itself sterile until the detachable strip is removed therefrom, that is until the bag is ready to be used.

Generally, commercial homogenizers or blenders used in laboratories to mix samples include a casing having a door which is pivoted to the casing and which, when open, reveal a chamber in the casing. In this chamber, there is provided paddles that are adapted to be repeatedly displaced by a motor. When the contents of a bag are to be mixed or blended, the door of the homogenizer is opened and the plastic bag and its contents are inserted into the homogenizer's chamber and the door is then closed such as to trap the upper end of the bag between the door and the casing while a lower portion of the bag and its contents are located in the chamber. The door, when closed, traps the upper end of the bag and thus firmly secures the same in a generally upright position in the homogenizer. The homogenizer is then switched on and the paddles, in a reciprocating movement, repeatedly pound the plastic bag and thus cause its contents to mix. After the homogenizer has been switched off, the door is opened and the bag is removed therefrom with the blended sample being now appropriately mixed and, for instance, ready for analysis.

In most homogenizers or blenders, the pivotable door cannot be removed from the rest of the blender. Furthermore, any rupture of the bag in the blender causes its contents to flow into the chamber of the blender and possibly onto the surface on which the homogenizer rests. This requires that the blender be extensively cleaned and there are some contamination risks in the laboratory.

To overcome this shortcoming, U.S. Pat. No. 6,267,498 issued on Jul. 31, 2001 15, 1996 to Lafond et al. discloses a blending device for mixing the contents of a plastic bag that comprises a casing defining a mixing chamber in which are disposed paddles or the like for acting on the bag and mix the contents thereof, and having a pivotable door for providing access to the chamber and positioning a bag and its contents in this chamber. The door includes a lower container which extends inwardly towards the casing such as to be located in the casing's mixing chamber when the door is in a closed position such that spillage resulting from a rupture of the bag in the blending machine is collected in the door's lower container. The door can be easily and completely disconnected from the casing for facilitating the cleaning thereof, for instance following a collection by the lower container thereof of a spillage.

SUMMARY OF THE INVENTION

It is therefore an aim of the present invention to provide an improved device for mixing or blending the contents of a bag and having a collecting member adapted to collect the bag's contents in the event of a rupture thereof.

It is also an aim of the present invention to provide a spillage collection member adapted to be installed on a blending or mixing device and to receive a bag having a content, such that spillage from the bag while in the device is collected in the spillage collection member.

Therefore, in accordance with the present invention, there is provided a blending device for mixing a content of a bag, comprising a casing defining a chamber and comprising a mixer and a door, in combination with a collection member adapted to receive therein a bag with a content to be mixed by said blending device and adapted to be installed in said blending device, wherein when said collection member and the bag are at least partly positioned in said chamber and said door is closed, said mixer may be operated to act on the bag and cause the content of the bag to be mixed, whereby at least most of the content of the bag spilling therefrom while the bag is in said blending device and said door is closed will be collected by said collection member.

Also in accordance with the present invention, there is provided a collection member for use with a blending device adapted to mix the contents of a bag, comprising an enclosure defining an opening for allowing a bag to be inserted therein and also defining a chamber for receiving the bag, wherein when said collection member and the bag are at least partly positioned in the blending device, said blending device may be operated to act on the bag and cause the content of the bag to be mixed, whereby at least most of the content of the bag spilling therefrom while the bag is in the blending device will be collected by said collection member.

Further in accordance with the present invention, there is provided a method for mixing a content of a bag in a blending device, comprising the steps of:

(a) providing a blending device defining a mixing chamber and having a mixer;

(b) providing a collection member adapted to receive therein a bag with a content to be mixed by said blending device;

(c) positioning said collection member at least partly in said blending device, wherein the bag is positioned in said collection member before step (d) and either before or after step (c); and (d) operating said mixer such that said mixer acts on the bag and cause the content of the bag to be mixed;

whereby at least most of a spillage from the bag, while the bag is in said blending device, is collected by said collection member.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
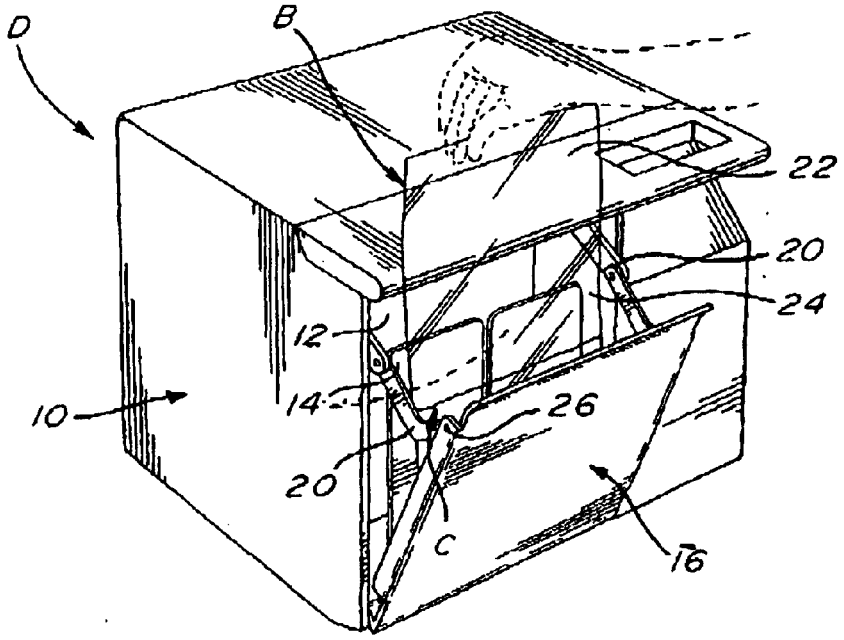
FIG. 1 (PRIOR ART)
FIG. 1 is a perspective view of a conventional device for blending the contents of a bag with a pivotable door thereof being shown in an open position thereof and with a bag being illustrated as it is positioned in the blending device.
Figure 2:
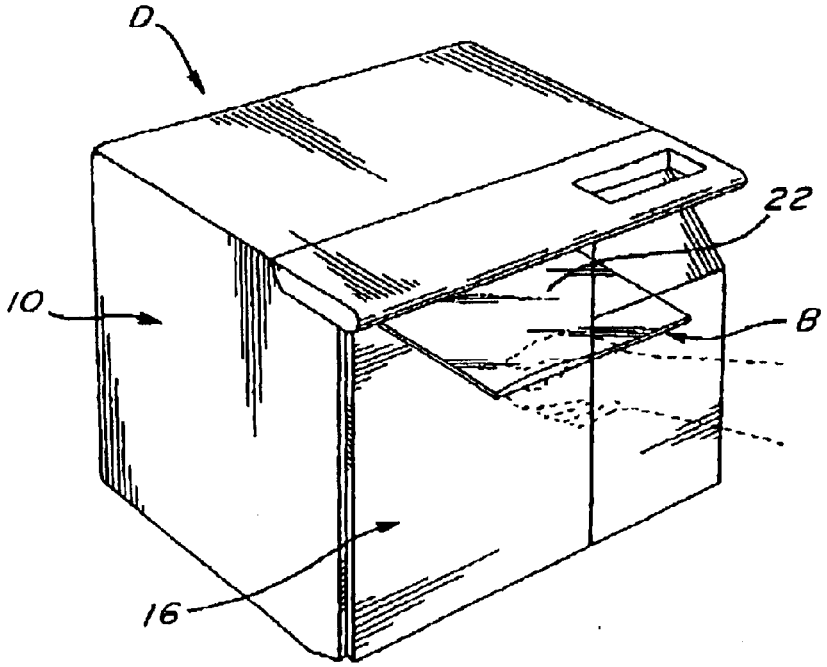
FIG. 2 (PRIOR ART)
FIG. 2 is a perspective view similar to FIG. 1 but showing the conventional blending device with its door in a closed position thereof, an upper portion of the bag extending outwardly of the blending device with a lower portion thereof and the bag's contents being located in the blending machine.
Figure 3:
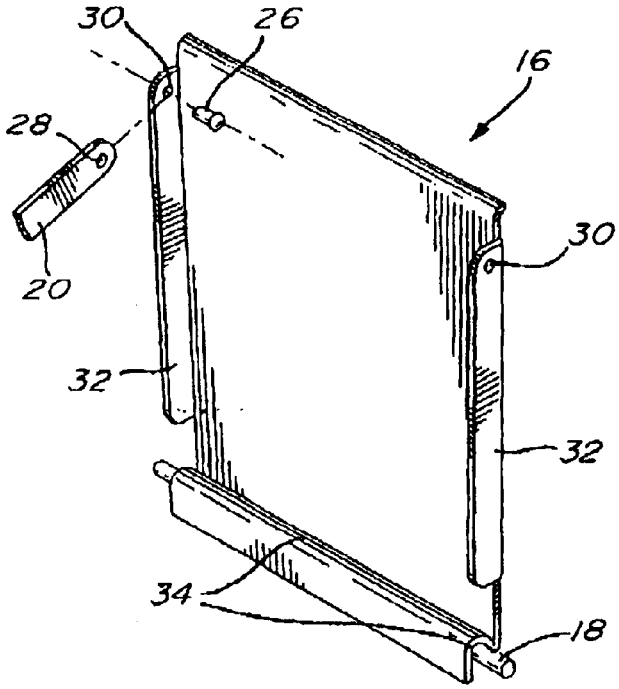
FIG. 3 (PRIOR ART)
FIG. 3 is a rear perspective view of the door of the conventional blending device of FIG. 1.

FIGS. 1 and 2 illustrate a blending device D of the prior art and comprising a casing 10 defining an inner chamber 12 in which are located a pair of paddles 14. The paddles 14 are actuated such as to displace in a reciprocating manner for reasons which will become apparent hereinbelow. Access to the chamber 12 is provided by a door 16 which is pivotally mounted at its bottom around a rod 18, as seen in FIG. 3. The upper end of the door 16 is pivotally mounted to the casing 12 by way of a pair of articulated linkages 20 which allow the door 16 to be pivoted about the rod 18 between open and closed positions, as shown respectively in FIGS. 1 and 2. When the door 16 is open, a flexible bag B may be introduced in the chamber 12, between the paddles 14 and the door 16, as well illustrated in FIG. 1. The bag B has a content C that is located opposite the paddles 14. When the door 16 is closed, as in FIG. 2, an upper portion 22 of the bag B is trapped between the door 16 and the casing 10 with a lower portion 24 of the bag P (see FIG. 1) including its content C being located in the chamber 12. Therefore, switching on the blending device D results in the displacement of the paddles 14 which repeatedly pound on the bag B such as to mix the contents C thereof.

As seen in FIG. 3, the door 16 is fixedly mounted to the linkages 20 (only part of one of which is shown in FIG. 3) by way of a pin 26, or rivet, which engages a hole 28 defined in the linkage 20 and which also engages a hole 30 defined in a respective one of the two side flanges 32 of the door 16. The lower end of the door 16 defines a fold 34 which engages by gravity the rod 18. It is therefore possible to displace the door 16 and the linkages 20 pivotally attached thereto in such a manner as to raise the door 16 out of engagement with the rod 18 with the door 16 being then pivoted above the blending device D In this position, which is not illustrated, easy access is provided to the paddles 14 and to the blending chamber 12 and this also allows the blending device D to be easily cleaned.

It must be noted that the above conventional blending device D becomes dirtied and possibly contaminated by any accidental spillage of the contents C of the bag B while the latter is in the blending device D. Indeed, if for instance during the blending of the contents C of the bag B under the repeated action of the reciprocating paddles 14, the bag B tears or ruptures, its contents C, or a portion thereof, may spill in the blending device D and also possibly on the surface onto which rests the blending device D and this may cause the contamination of the blending device D and/or the room in which it is located. Furthermore, the door 16 cannot be completely detached from the casing 10.

Figure 4:
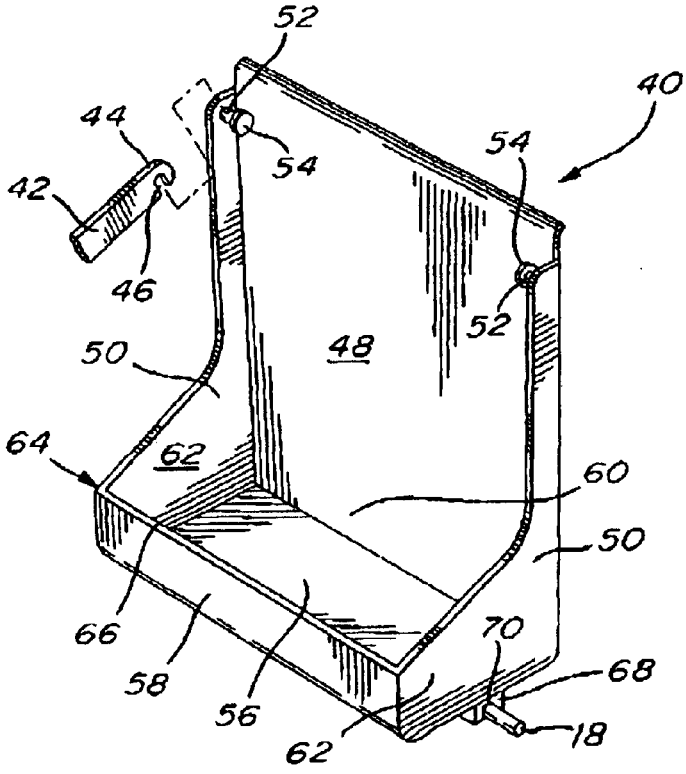
FIG. 4 (PRIOR ART)
FIG. 4 is a rear perspective view of a door of another conventional blending machine, this door having an inner collection container.

FIG. 4 shows a variant door, wherein, the door 16 and the linkages 20 of the conventional blending device of FIGS. 1 to 3 have been modified. More particularly, FIG. 4 shows a new door 40 (made of stainless steel) and associated linkages 42. Each linkage 42 defines at its end 44 which connects to the door 40 a notch 46 such that the linkage end 44 has the form of a hook open at its bottom. The door 40 defines a front wall 48 and a pair of side walls 50 extending inwardly, that is towards the casing 10, from the front wall 48. It must be noted that FIG. 4, as in FIG. 3, is a perspective view which considers the door 40 from the inside, that is outwardly from the casing 10. At the upper end of each side wall 50, there extends inwardly and horizontally a pin 52 provided with a head 54 which is spaced apart from the side wall 50. Therefore, the cylindrical stem of the pin 52 located between the side wall 50 of the door 40 and the head 54 of the pin 52 can be received in the notch 46 of the linkage 42, such that the linkages 42 can be selectively disconnected from the pins 52 and thus from the door 40.

The door 40 also includes a bottom wall 56 and a rear wall 58 that, with a lower portion 60 of the front wall 48 and lower portions 62 of the side walls 50, define a collection container 64 at the lower end of the door 40. When the bag B is in the blending device adapted with the present door 40 and with this door 40 being in a closed position similar to that shown in FIG. 2, the lower portion of the bag B and its contents C positioned in the mixing chamber 12 of the blending device are located above the bottom wall 56 of the container 64.

An elongated nylon member 68 is secured to the underside of the bottom wall 56 and defines on a lower surface thereof a semi-circular trough 70 which engages the rod 18 fixed to the casing 10. Alternatively, the elongated nylon member 68 could take the form of a steel bar welded to the casing. As for the door 16 of FIGS. 1 to 3, the rod 18, albeit shown in both FIGS. 3 and 4, is not part of the door 40 (and of the door 16) as it is fixedly mounted to the casing 10, but is shown herein in FIGS. 3 and 4 for clearly illustrating the engagement of the doors 16 and 40 to this support rod 18. The present door 40 engages by gravity the support rod 18 such that the door 40 can be completely disconnected from the casing 10 by disengaging the linkages 42 from the pins 52 of the door 40 and by elevating the door 40 and thus the elongated member 68 out of engagement with the support rod 18.

Typically, the collection container 64 will be dimensioned such as to be able to collect the full contents of the bag B; for instance, the bags are filled to contain often at most 400 ml substance to be blended, whereby the container 64 is configured to contain slightly more than 400 ml.

Figure 5:
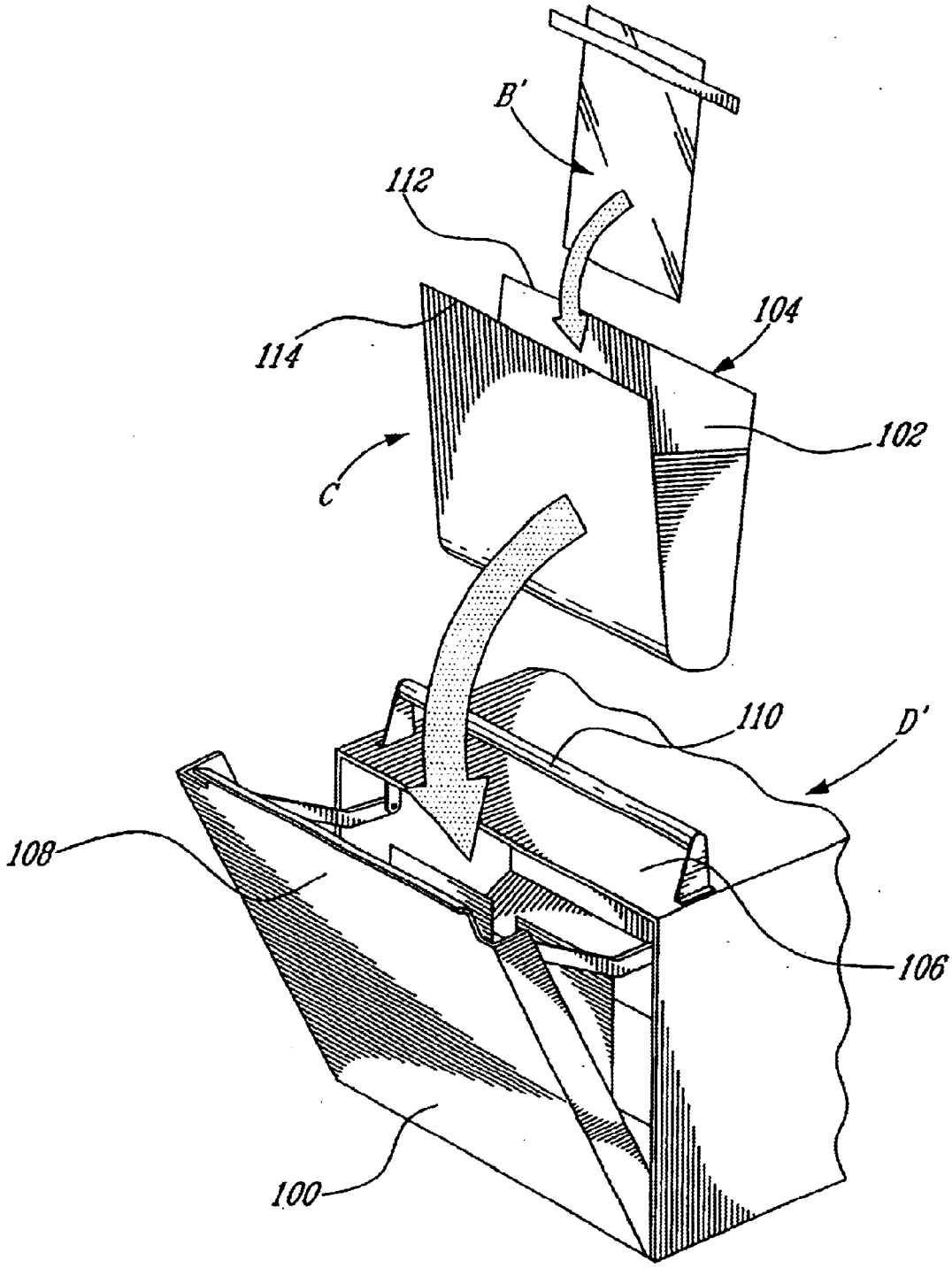
FIG. 5 is a perspective view of a spillage collection bag in accordance with the present invention, shown prior to receiving therein a sampling bag and prior to being installed on a blending machine.

FIG. 5 shows part of a blending device D' having a door 100 thereof in an open position such that a sampling bag B', containing a substance to be mixed by the blending device D', can be inserted in the device D'. In accordance with the present invention, FIG. 5 also illustrates a spillage collection member in the form of a collection bag C that is adapted to be installed in the blending device D' and to hold therein the sampling bag B'. The collection bag C is open-ended at its upper end so as to define a chamber 102 that receives the sampling bag B'. As, when the sampling bag BE is in the blending device D', it is carried by the collection bag C, any spillage from the sampling bag BE is collected in the collection bag C rather than spilling into the blending device D'.

The collection bag C may be provided with sides. It is made of a resistant material, which is capable of resisting to the mixing/pounding action imparted by the blending device D' to mix the contents of the sampling bag B', as well as to a cleaning process, to an autoclave, etc.

When positioned in the blending device D', the collection bag C is located between the inside of the door 100 and the paddles (e.g. paddles 14 in FIG. 1) of the blending device D', with the sampling bag B' being located inside the collection bag C, i.e. in the chamber 102 thereof.

The collection bag C can be made of various materials, and can adopt various shapes. The collection bag C is made of a tight material to prevent any leakage therefrom. It can be made, for instance, of a rubber material that offers a very good resistance to perforation and a good resistance to solvents.

The main advantage of the collection bag C over the collection container 64 of the door 40 of FIG. 4 lies in that the collection bag C of the present invention can be used with any type of blending device, whereas the collection container 64 is integral to a given blending device.

The collection bag C can be installed to the blending device D' using various means to ensure its stability in the device D' during the mixing process, including an attachment system to detachably secure an upper end 104 of the collection bag C to the outside of the blending device D' (e.g. at location 106 and 108 respectively on the casing of the device D' and on the door 100 thereof in FIG. 5). Such an attachment system can comprise cooperating Velcro™ strips provided on one and the other of the upper end 104 of the collection bag C and the outside of the casing of the device D' Detachable adhesives, double-sided tapes, as well as other systems, can also be contemplated. The upper end 104 could also be slidably inserted in a member that defines a groove and that is permanently affixed to the blending device D', parallelly to a handle 110 located atop the device D', with a screw, or any other suitable anchoring system.

More particularly, a rear portion 112 of the upper end 104 can be detachably secured (with any of the attachment means mentioned above, as well as with any other suitable ones) to the device D' generally at location 106 thereof. A front portion 114 of the upper end 104 can be detachably secured (with any of the attachment means mentioned above, as well as with any other suitable ones) to the outside of the door 100 of the device D', e.g. generally at location 108 thereof, when the front portion can extend outwardly of the device D', or directly to the inside of the door 100, When the front portion 114 extend outwardly of the device D', it can also be held in place by imprisonment when the door 100 is closed.

Therefore, the collection bag C of the present invention can be adapted so that it can be used with any blending device.

We claim:

1. A blending device for mixing a content of a bag, comprising a casing defining a chamber and comprising a mixer and a door, in combination with a collection member adapted to receive therein a bag with a content to be mixed by said blending device and adapted to be installed in said blending device, wherein when said collection member and the bag are at least partly positioned in said chamber and said door is closed, said mixer may be operated to act on the bag and cause the content of the bag to be mixed, whereby at least most of the content of the bag spilling therefrom while the bag is in said blending device and said door is closed will be collected by said collection member.

2. The combination of a blending device and a collection member as defined in claim 1, further comprising an attachment system for detachably securing an upper end of said collection member to said blending device.

3. The combination of a blending device and a collection member as defined in claim 2, wherein said attachment system comprises cooperating Velcro™ strips provided on one and the other of said upper end of said collection member and an outside of said casing.

4. The combination of a blending device and a collection member as defined in claim 3, wherein said collection member comprises a flexible collection bag that is open-ended at said upper end.

5. The combination of a blending device and a collection member as defined in claim 2, wherein said collection member comprises a flexible collection bag that is open-ended at said upper end.

6. A collection member for use with a blending device adapted to mix the contents of a bag, comprising an enclosure defining an opening for allowing a bag to be inserted therein and also defining a chamber for receiving the bag, wherein when said collection member and the bag are at least partly positioned in the blending device, said blending device may be operated to act on the bag and cause the content of the bag to be mixed, whereby at least most of the content of the bag spilling therefrom while the bag is in the blending device will be collected by said collection member.

7. A collection member as defined in claim 6, further comprising an attachment system for detachably securing an upper end of said collection member to the blending device.

8. A collection member as defined in claim 7, wherein said attachment system comprises first and second cooperating Velcro™ strips, said first strip being adapted to be secured at said upper end of said collection member, whereas said second strip is adapted to be secured on an outside surface of said casing.

9. A collection member as defined in claim 8, wherein said collection member comprises a flexible collection bag that is open-ended at said upper end.

10. A collection member as defined in claim 7, wherein said collection member comprises a flexible collection bag that is open-ended at said upper end.

11. A method for mixing a content of a bag in a blending device, comprising the steps of:

(a) providing a blending device defining a mixing chamber and having a mixer;

(b) providing a collection member adapted to receive therein a bag with a content to be mixed by said blending device;

(c) positioning said collection member at least partly in said blending device, wherein the bag is positioned in said collection member before step (d) and either before or after step (c); and (d) operating said mixer such that said mixer acts on the bag and cause the content of the bag to be mixed;

whereby at least most of a spillage from the bag, while the bag is in said blending device, is collected by said collection member.

* * * * *